US007748307B2

(12) United States Patent
Hallissy et al.

(10) Patent No.: US 7,748,307 B2
(45) Date of Patent: Jul. 6, 2010

(54) SHIELDING FOR STRUCTURAL SUPPORT ELEMENTS

(76) Inventors: Gerald Hallissy, 15 Overlook Dr., Port Washington, NY (US) 11050; William Higbie, 985 Thompson Dr., Bay Shore, NY (US) 11706

( * ) Notice: Subject to any disclaimer, the term of this patent is extended or adjusted under 35 U.S.C. 154(b) by 108 days.

(21) Appl. No.: 11/499,101

(22) Filed: Aug. 4, 2006

(65) Prior Publication Data

US 2008/0121151 A1 May 29, 2008

(51) Int. Cl.
*F41H 5/24* (2006.01)

(52) U.S. Cl. ..... 89/36.04; 89/36.01; 52/319; 52/167.1

(58) Field of Classification Search ..... 89/36.04, 89/36.02; 52/319, 167.1, 167.3
See application file for complete search history.

(56) References Cited

U.S. PATENT DOCUMENTS 4,225,278 A 9/1980 Weiner
4,252,471 A * 2/1981 Straub ..... 405/211
4,404,889 A 9/1983 Miguel
4,651,479 A 3/1987 Kersavage
4,709,980 A * 12/1987 Coll et al. ..... 385/134
4,764,774 A 8/1988 Hildebrand et al.
4,790,691 A 12/1988 Freed
4,837,885 A * 6/1989 Yang ..... 14/21
4,867,614 A 9/1989 Freed
4,889,258 A 12/1989 Yerushalmi
4,896,613 A 1/1990 Salzer
4,901,498 A 2/1990 Gerwick
5,006,386 A * 4/1991 Menichini ..... 428/58
5,189,859 A 3/1993 Payer
5,214,896 A 6/1993 Hamilton
5,267,665 A 12/1993 Sanai et al.
5,390,580 A 2/1995 Gibbons et al.
5,456,752 A 10/1995 Hogan
5,545,455 A 8/1996 Prevorsek et al.
5,582,119 A 12/1996 Barkdoll (Continued)

FOREIGN PATENT DOCUMENTS

CA 2250659 4/2000

(Continued)

OTHER PUBLICATIONS (2004) "Hardwire Steel-Belted Reinforcement Product Provides New Solution for Blast-Resistance Need." Powered by Business Wire. www.tmcnet.com/usubmit/2004/Aug/1065902.htm.

(Continued)

*Primary Examiner*—Stephen M Johnson
*Assistant Examiner*—Daniel J Troy
(74) *Attorney, Agent, or Firm*—Hoffmann & Baron, LLP

(57) ABSTRACT

A shield for shielding a structural member from an explosive blast or accidental or malicious destruction is provided. The shield includes a plurality of shield members which include cast ultra high strength concrete, wherein the shield members are capable of being assembled to enclose at least a portion of the structural member to provide protection to the enclosed portion from, for example, an explosive blast. In one embodiment, the shield members include a chassis, at least one ballistic liner disposed on the energy absorbing layer, and a concrete-integrating structure.

36 Claims, 6 Drawing Sheets

U.S. PATENT DOCUMENTS

| | | | | |
|---|---|---|---|---|
| 5,628,822 | A | 5/1997 | Hogan | |
| 5,668,342 | A | 9/1997 | Discher | |
| 5,862,640 | A | 1/1999 | Negri | |
| 5,950,380 | A | 9/1999 | Pearson | |
| 5,981,630 | A | 11/1999 | Banthia et al. | |
| 5,993,537 | A | 11/1999 | Trottier et al. | |
| 6,029,269 | A | 2/2000 | El-Soudani | |
| 6,120,975 | A | 9/2000 | Tokai et al. | |
| 6,138,420 | A | 10/2000 | Fyfe | |
| 6,173,662 | B1 | 1/2001 | Donovan | |
| 6,185,882 | B1 | 2/2001 | Pearson | |
| 6,216,579 | B1 | 4/2001 | Boos et al. | |
| 6,240,858 | B1 | 6/2001 | Mandall | |
| 6,309,732 | B1 | 10/2001 | Lopez-Anido et al. | |
| 6,312,864 | B1 | 11/2001 | Tokai et al. | |
| 6,333,085 | B1 | 12/2001 | Emek | |
| 6,341,708 | B1 | 1/2002 | Palley et al. | |
| 6,412,231 | B1 | 7/2002 | Palatin | |
| 6,423,134 | B1 | 7/2002 | Trottier et al. | |
| 6,455,131 | B2 | 9/2002 | Lopez-Anido et al. | |
| 6,500,507 | B1 | 12/2002 | Fisher | |
| 6,544,624 | B1 | 4/2003 | Lopez-Anido et al. | |
| 6,685,387 | B2 | 2/2004 | Allen et al. | |
| 6,806,212 | B2 | 10/2004 | Fyfe | |
| 6,811,877 | B2 | 11/2004 | Haislet et al. | |
| 6,862,847 | B2 | 3/2005 | Bigelow | |
| 6,873,920 | B2 | 3/2005 | Dunleavy, et al. | |
| 6,887,309 | B2 * | 5/2005 | Casanova et al. | 106/644 |
| 6,901,839 | B2 | 6/2005 | Edberg et al. | |
| 6,960,388 | B2 | 11/2005 | Hallissy et al. | |
| 6,964,219 | B2 | 11/2005 | Gilon | |
| 6,971,817 | B2 | 12/2005 | Allen et al. | |
| 6,991,124 | B1 | 1/2006 | Palley et al. | |
| 7,014,059 | B2 | 3/2006 | Reynolds | |
| 7,305,799 | B2 * | 12/2007 | Smelser et al. | 52/167.3 |
| 7,373,758 | B2 * | 5/2008 | Tsai et al. | 52/834 |
| 2001/0036535 | A1 | 11/2001 | Lopez-Anido et al. | |
| 2002/0152881 | A1 * | 10/2002 | Stevens et al. | 89/36.17 |
| 2003/0064191 | A1 | 4/2003 | Fisher | |
| 2003/0085482 | A1 * | 5/2003 | Sincock et al. | 264/32 |
| 2003/0106414 | A1 | 6/2003 | Wang | |
| 2003/0148681 | A1 | 8/2003 | Fyfe | |
| 2003/0167726 | A1 | 9/2003 | Dunleavy et al. | |
| 2003/0213188 | A1 | 11/2003 | Bigelow | |
| 2004/0054035 | A1 * | 3/2004 | Hallissy et al. | 523/219 |
| 2004/0194614 | A1 | 10/2004 | Wang | |
| 2005/0091938 | A1 * | 5/2005 | Wobben | 52/302.1 |
| 2005/0144900 | A1 | 7/2005 | Hallissy et al. | |
| 2005/0188825 | A1 | 9/2005 | Sharpe et al. | |
| 2005/0204696 | A1 | 9/2005 | Hall | |
| 2005/0285012 | A1 | 12/2005 | Walton | |
| 2006/0021682 | A1 | 2/2006 | Saha et al. | |
| 2006/0042115 | A1 | 3/2006 | Karr et al. | |
| 2006/0070281 | A1 | 4/2006 | Passannante | |
| 2006/0090673 | A1 | 5/2006 | Simmonsen et al. | |
| 2007/0137471 | A1 * | 6/2007 | Mazur | 89/36.02 |

FOREIGN PATENT DOCUMENTS

| | | |
|---|---|---|
| EP | 0897097 | 2/1999 |
| GB | 1318718 | 5/1973 |
| GB | 2238283 | 5/1991 |
| KR | 240376 | 1/2000 |
| WO | WO9107275 | 5/1991 |
| WO | WO9802607 | 1/1998 |
| WO | WO2005/014964 | 2/2005 |
| WO | WO2005/098343 | 10/2005 |

OTHER PUBLICATIONS

"Honeywell Advanced Fibers and Composites." Spectra Fiber. www.honeywell.com/sites/sm/afc/spectra_fiber.htm.

"Kaowool high purity cerablanket—2,400° F." Thermal Ceramics. www.anvilfire.com/sales/pages/kaowool.htm.

"ITC 100 HT Ceramic Coating." www.anvilfire.com/sales/ITC/100.htm.

"ITC 200 EZ Ceramic Fill." www.anvilfire.com/sales/ITC/200.htm.

* cited by examiner

SHIELDING FOR STRUCTURAL SUPPORT ELEMENTS

BACKGROUND OF THE INVENTION

The invention relates to blast and ballistic shielding for structural support elements for buildings, bridges, transportation infrastructure and vehicles, and in particular to pre-formed shielding which provides protection from the effects of blast(s) from explosives or accidental or malicious destruction.

Due to increased threats and awareness of potential terrorist activities, increased attention is being given to protecting structures of all types against damage from fire, explosion, and other threats, malicious and accidental, to structural elements of buildings and the like. An example is U.S. Pat. No. 6,960,388 to Hallissy, et al. which discloses and claims flexible but intumescent coatings for an electrical conduit which, when exposed to intense heat, forms an expandable insulative layer about the conduit. This provides increased protection for electrical and communication cables and wires which the conduit encases.

There is a need for blast and/or ballistic impact resistant barrier structures for use in both existing and new construction/manufacturing for exposed structural elements. Exposed structural elements of buildings and transportation infrastructure are particularly vulnerable targets for terrorist activity. One particularly vulnerable structural element that is widely used in construction is tension cables. Tension cables, generally of steel, have long been used in design and construction of suspension bridges, and are finding increasing use in structures of all types. While designs employing such tension cables always employ a certain degree of redundancy, damages to numerous cables can have a catastrophic effect. Damage in the case of explosive devices is particularly problematic, since even small "nicks" in highly tension metal can create failure modes which are largely absent in non-tension structures.

It would be desirable to provide systems that are relatively inexpensive and have an acceptable weight efficiency which can protect both existing and new exposed structural elements against damage by explosive devices, both in terms of the energy created by the explosion per se as well as from flying objects/debris created during explosive blasts, as well as from other threats to the integrity of the structural element.

SUMMARY OF THE INVENTION

According to the present invention, a shield is provided which shields an exposed structural element from, among other things, an explosive blast and ensuing fire. The shield of the present invention can be retrofitted onto existing structures or installed in new construction. The shield includes at least two pre-formed shield members that are assembled to enclose at least a portion of a structural element to provide protection to the enclosed portion.

The assembled shield protects structural elements from blast energy, ballistic threats, and flying debris. The structural member can be a structural component of a building or a vehicle, or, for example, a tension cable (or cables) which supports suspension bridges and the like, e.g., viaducts, etc. And the shield members can be made so that they interlock, e.g., can be slidably interlocked, around the enclosed portion of the structural member.

The energy absorbing shield can, in one primary embodiment, include mainly an ultra high strength concrete. In a second primary embodiment, the shield can include a chassis and at least one ballistic liner, preferably an ultra high strength concrete, disposed on the chassis such that the chassis is more proximal to the structural member than the ballistic liner. In both embodiments the shield includes at least two shield members which are capable of being assembled to enclose at least a portion of the structural member to provide protection to the enclosed portion from an explosive blast and ensuing fire.

The ultra high strength concrete, which can be pre-cast, includes metallic fibers. Preferably, the metallic fibers are present in an amount of up to about 120 kg/m$^3$, more preferably in an amount of about 20 to about 120 kg/m$^3$ of concrete, and most preferably in an amount of about 40 to about 100 kg/m$^3$ of concrete. The metallic fibers preferably include steel fibers.

The ultra high strength concrete preferably shows a flexure strength Rfl measured on prismatic samples, higher than or equal to 15 MPa and a compression strength Rc measured on cylindrical samples, higher than of equal to 120 Mpa, the flexural strength and compression strength being evaluated at the end of a 28 day time period.

The chassis of the second primary embodiment is preferably a metal plate which includes a metal selected from the group consisting of aluminum, steel, stainless steel, titanium and mixtures and/or alloys thereof. The metal chassis can be in the form of a hinged assembly capable of pivoting to surround the enclosed portion of the structural member. The chassis can also include interlocking, spaced-apart tabs or fingers which cooperate to assemble around the structural member.

In the second primary embodiment, the shield members further include a concrete-integrating-structure embedded in the concrete, which is preferably attached to the chassis prior to application of concrete to the chassis. The concrete-integrating-structure is preferably made of metal, most especially steel.

In both embodiments, the thickness of the ballistic liner, especially the ultra high strength concrete, is sufficient to significantly reduce (or, indeed, eliminate) damage to the cable. Preferably, the lower limit of thickness of the ultra high strength concrete (ballistic liner) is at least about 0.5 inches, preferably at least about 1.0 inch, and most preferably at least about 1.5 inches. Meanwhile the upper limit of the thickness of the concrete (e.g., ballistic liner) is not greater than about 4.0 inches, preferably not greater than about 3.0 inches, and most preferably not greater than about 2.5 inches. Any combination of upper and lower limits of thickness set forth above can be combined and used as part of this invention.

In all embodiments, at least one shield member can also include at least one data sensor for detecting a threat to the shield and/or the protected structural member. Preferably, the sensor detects a threat selected from the group consisting of an elevated temperature, excessive vibrations, an explosive blast and other events affecting the integrity of the shield assembly. This inventive feature can also include a system for transmitting threat data to a remote receiver.

Both embodiments can also include a solar collector which can power the sensor/transmitter. A heat tracing wire can be used in all embodiments to dehumidify annular space within the shield so that corrosion damage is mitigated. And a solar collector can be used to power the heat tracing wire.

The shield members can also include at least one heat resistant coating, which is preferably disposed adjacent to the structural member upon assembly of the shield. An exterior and/or interior heat resistant coating can be made of an intumescent coating for an electrical conduit as disclosed in U.S. Pat. No. 6,960,388.

When the structural member is a tension cable, the shield can have a substantially annular shape with an inner surface adjacent to the cable and an outer surface facing outward towards a potential explosive blast source. In such an embodiment, the shield can also include at least one end cap which fits around the tension cable sufficiently snugly to substantially prevent weather and debris from entering the annular space.

In both of the primary embodiments, i.e., (i) the first primary embodiment which includes mainly concrete and (ii) the second primary embodiment which includes a chassis and at least one ballistic liner, can further include a blast defeating layer disposed on the surface exposed to blast. The blast defeating layer preferably includes a metal selected from the group consisting of aluminum, steel, stainless steel, titanium, and mixtures and/or alloys thereof.

The present invention also includes a system having a thermally-insulative/ballistic liner disposed on the structural member, especially tension cables, before assembling the shield to enclose the structural member. The thermally-insulative/ballistic liner is a jacket which can include a woven or non-woven textile fabric or combination thereof. The material used can be selected from the group consisting of glass fibers, polyaramide fibers, polyolefin fiber, aliphatic polyamide fibers, steel fibers, titanium fibers, carbon fibers, ceramic fibers and mixtures or alloys thereof. The liner jacket, which is secured to the structural member, can increase the ballistic and/or heat protection afforded the structural member, e.g., cable. The liner can also include a blanket layer disposed between the jacket and the protected structure, e.g., cable. The blanket can be a refractory material, e.g., Kaowool™ refractory blanket and/or Inswool™ refractory blanket.

The invention also includes a method for mitigating damage to a structural member from an explosive blast, which includes assembling a shield (with or without the liner) as set forth herein around the structural member. Preferably, the structural member is a tension cable.

Additional objects, advantages and novel features of the invention will be set forth in part in the detailed description which follows, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

Preferred embodiments of the invention have been chosen for purposes of illustration and description and are shown in the accompanying drawings, wherein.

DETAILED DESCRIPTION OF THE INVENTION

The present invention provides a shield that is relatively inexpensive and is easily constructed, which shields an exposed structural element from an explosive blast and fire. The shield can be retrofitted onto existing structures or installed in new construction. One primary embodiment of the invention provides a shield that includes at least two shield members made mainly of pre-cast ultra high strength concrete. The shield members are capable of being assembled to enclose at least a portion of the structural member to provide protection to the enclosed portion from an explosive blast.

Figure 6:
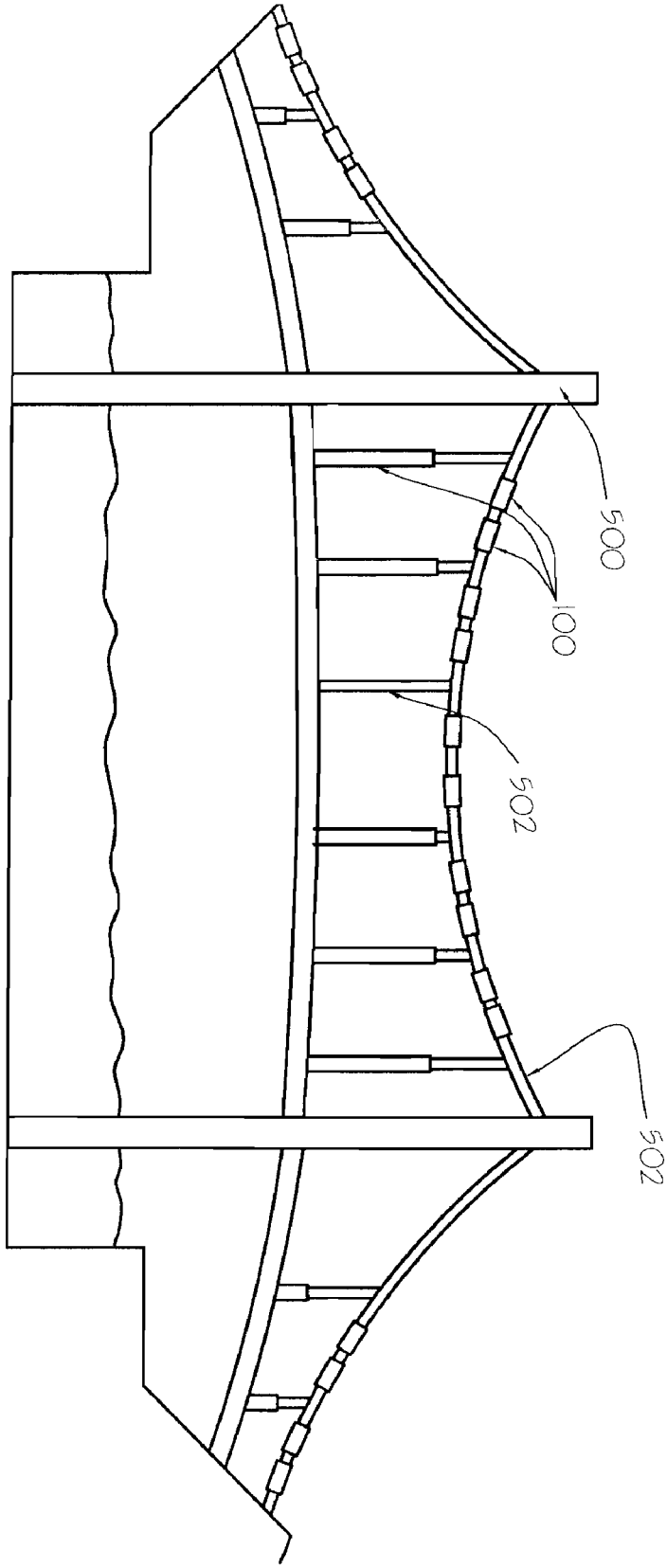
FIG. 6 is a side view of a suspension bridge having a plurality of shields according to the present invention.

As shown in FIG. 6, in one preferred embodiment, the structural element or member is a tension cable 502. Tension cables are well known and details of structures using such cables can be obtained from numerous textbooks and treatises on civil engineering and architecture. Numerous variants are possible, and most cables for heavy structures and/or tall structures such as radio or television broadcast towers, suspension bridges 500, transmission towers, stadium towers, viaducts and the like, consist of a plurality of smaller cables, which may run parallel to each other or which may be twisted together. Likewise, each of these plurality of smaller cables can contain numerous strands of wire, twisted together in numerous patterns. The material of construction is generally high tensile strength carbon steel, although occasionally stainless steel or even metals such as aluminum can be used.

Ultra High Strength Concrete Shield

Figure 1:
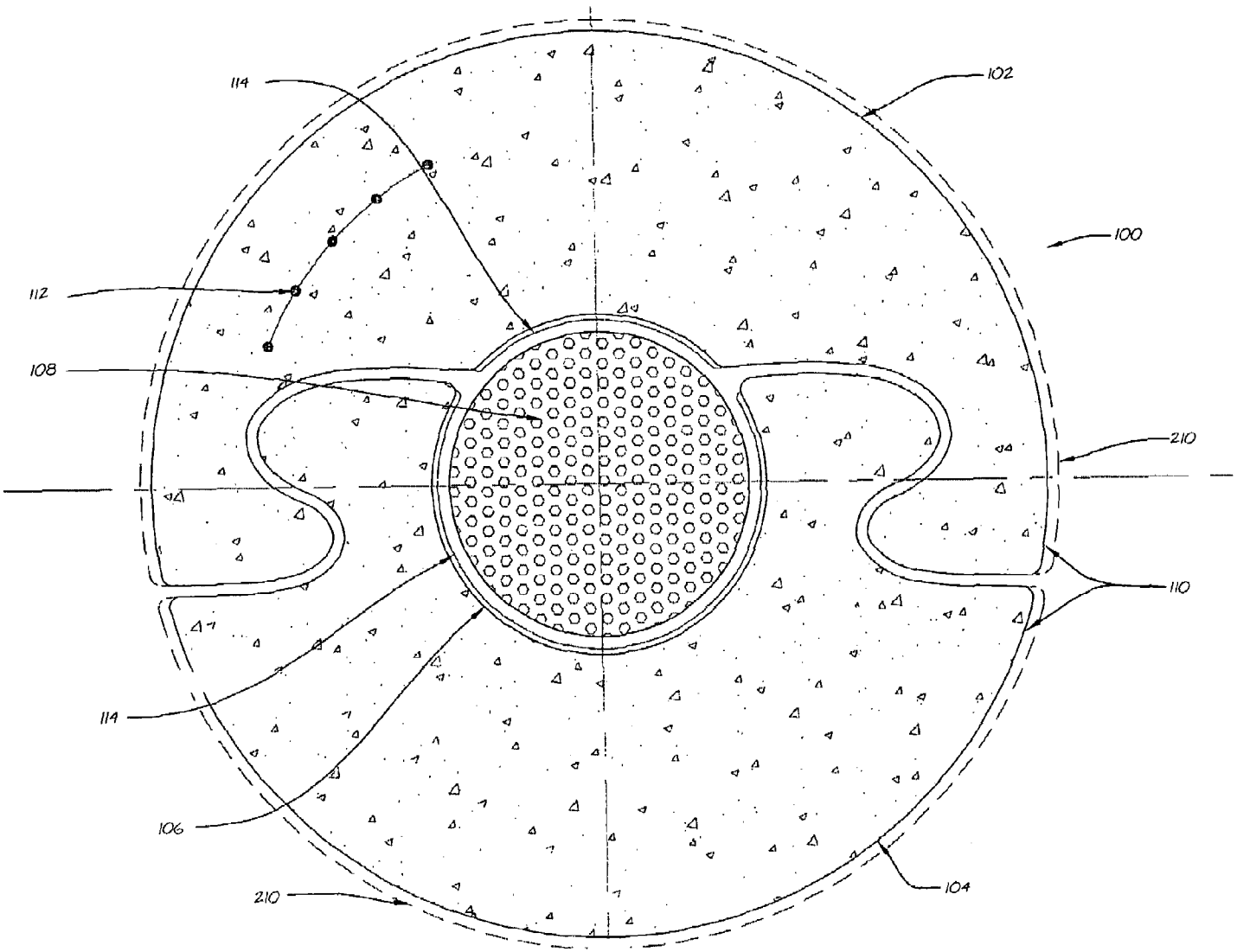
FIG. 1 is a cross-sectional view of a shield according to a first primary embodiment of the invention that has been slidably interlocked around a tension cable to be protected.

Referring to the drawings there is shown in FIG. 1 a cross-sectional view of a shield 100 assembled around a cable which includes a first shield member 102 and a second shield member 104 that are slidably interlocked to provide a substantially annular shape having and inner surface 106 surrounding a tension cable 108 and an outer surface 110 facing explosive threat. The first and second shield members 102 and 104 are a pre-cast ultra high strength concrete material having a wall thickness sufficient to provide protection to the tension cable 108 from an explosive blast.

The ultra high strength concrete material should be capable of absorbing and distributing energy from an explosive blast, so that the integrity of a tension cable 108 enclosed by assembled shield members is preserved after an explosive blast occurs external to the shield 100. The ultra high strength concrete is preferably an ultra high strength reactive powder concrete that contains ductile fibers. The fibers are preferably of a type and present in an amount sufficient to absorb energy transmitted by the blast itself and to enhance protection from flying debris secondary to the blast. The fibers can be high carbon steel or poly vinyl alcohol fibers. Examples of suitable concrete materials are disclosed in U.S. Pat. No. 6,887,309 to Casanova et al., which is incorporated herein by reference in its entirety, and sold under the name Ductal® by LaFarge.

The LaFarge concrete has metallic fibers dispersed in a composition having a cement; ultrafine elements with a pozzolanic reaction; granular elements distributed into two granular classes ($C_1$)>1 mm and <5 mm and ($C_2$) ranges from 5 to 15 mm; cement additions; an amount of water E added in the mixture; a dispersant, and preferably a superplasticizer;

metallic fibers, in an amount maximum equal to 120 kg per $m^3$ of concrete, the contents of the various components (a), (b), ($C_1$), ($C_2$), (d) and the amount of water E, expressed in volume, meeting the following relationships: ratio 1: $0.50 \leqq (C_2)/(C_1) \leqq 1.20$; ratio 2: $0.25 \leqq [(a)+(b)+(d)]/[(C_1)+(C_2)] \leqq 0.60$; ratio 3: $0.10 \leqq (b)/(a) \leqq 0.30$; ratio 4: $0.05 \leqq E/[(a)+(b)+(d)] \leqq 0.75$; ratio 5: $(d)/(a) \leqq 0.20$. The cement includes particles having grain size D50 ranging from 10 to 20 mm, and the ultrafine granular sizes having grain size D50 of maximum 1.0 mm.

The wall thickness of the ultra high strength concrete is sufficient to significantly reduce the occurrences of cuts, nicks and parting of the cable compared to an unprotected cable. Preferably, the wall thickness is from about 0.5 inch to about 4.0 inches, more preferably from about 1.0 inch to about 3.0 inches, and most preferably from about 1.5 inches to about 2.5 inches. Thus, the lower limits of the wall thickness is not less than about 0.5 inches, preferably not less than about 1.0 inches, and most preferably not less than about 1.5 inches; whereas the upper limit of the wall thickness is not greater than about 4.0 inches, preferably not greater than about 3.0 inches, and most preferably not greater than about 2.5 inches. (The same wall thicknesses set forth above are used in other embodiments of the invention).

The first shield member 102 can also include at least one, but preferably a plurality of, data sensor(s) 112 embedded in the ultra high strength concrete matrix. (See also sensors 132 shown in FIG. 2). The sensors 112 detect threats to the shield 100 and/or the tension cable 108. For example, a steel tension cable will typically lose significant strength and will be at risk for failure if it reaches a temperature of about 300° C.-350° C. Accordingly, a temperature sensor can be used to detect heat threat to the tension cable. Depending on the type of tension cable, sensors can be included in the shield member to detect a threat selected from the group consisting of elevated temperature (heat), excessive vibration, shock from an explosion and other factors affecting the integrity of the shield assembly.

The shield can also include a system for transmitting threat data to a remote location (not shown). The system can include a transmitter and a power source to receive the threat data from the data sensors and transmit the data to a remote location. In a preferred embodiment, the power source includes a solar collector, such as collector 182 shown in FIG. 5 of the second primary embodiment, and the transmitter can transmit the data via wireless communication.

The shield can also include at least one heat resistant coating 114 in FIG. 1 between the inner surface of the shield and the tension cable. A heat resistant coating can also be applied to the exterior surface, but is preferably applied to the inner surface of the shield. The coating is preferably a flexible, adherent coating which, when exposed to high temperatures, expands to form an insulative yet coherent coating to insulate the tension cable from the high temperature. Examples of suitable insulative materials are the coatings disclosed in U.S. Pat. No. 6,960,388 to Hallissy et al., which is incorporated herein by reference in its entirety.

Combined Chassis and Ballistic Liner

Figure 2:
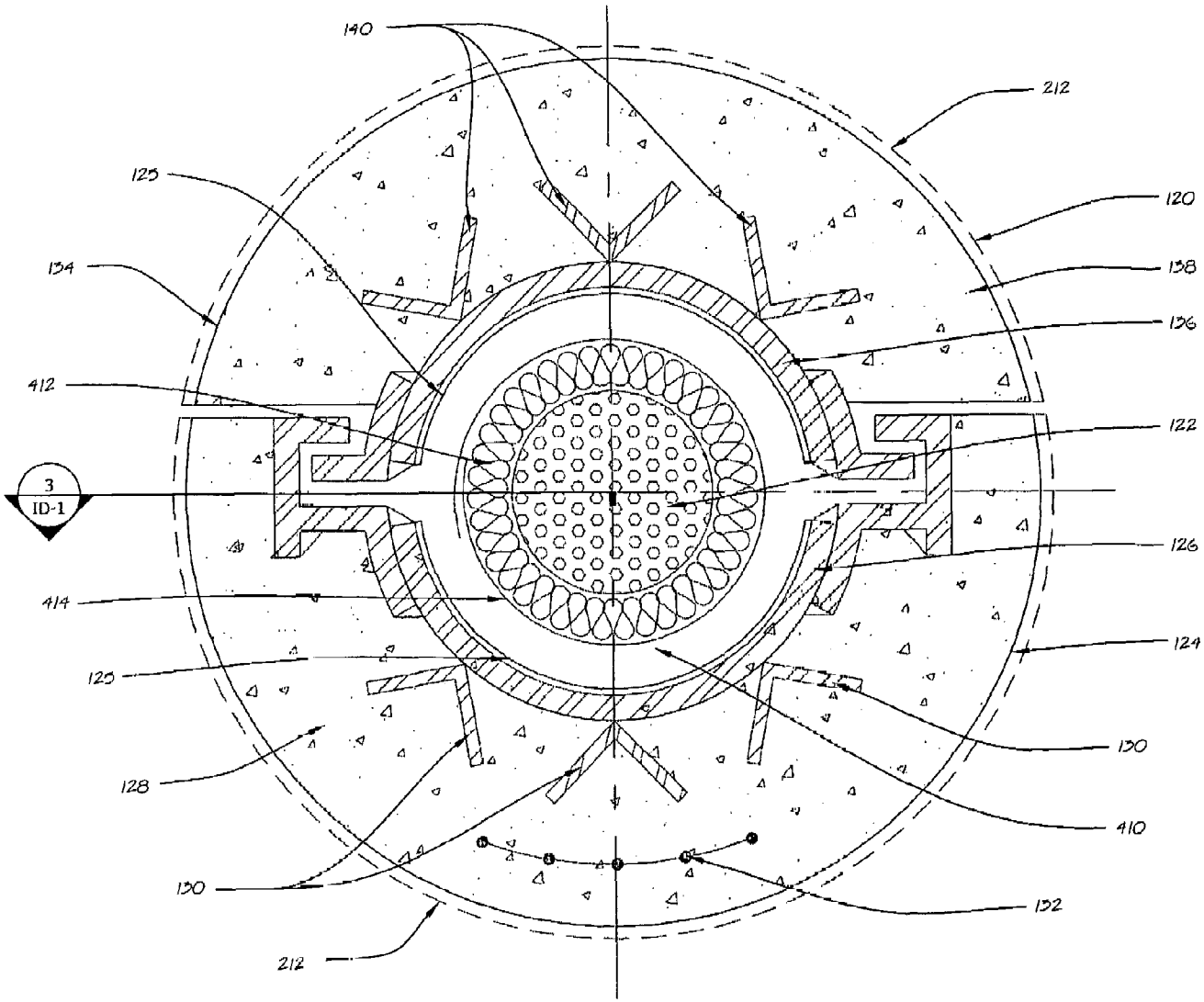
FIG. 2 is a cross-sectional view of a shield according to a second primary embodiment of the invention that includes a metal chassis that has been slidably interlocked around a tension cable to be protected.

In a second primary embodiment, the ballistic liner can be attached to the chassis (which is preferably metal) by casting ultra high strength concrete (as described above) onto the chassis. The chassis can be hinged, slotted together, screwed, welded or otherwise assembled and secured around tension cables. Referring to FIG. 2, a cross-sectional view of a shield 120 is depicted according to this second primary embodiment of the invention. The shield 120 surrounds a tension cable 122 and includes a shield 120 assembled from a first shield member 124 having a chassis 126 and a first ballistic liner 128 made of an ultra high strength concrete casting on the chassis 126.

The shield member also has a first metal concrete-integrating-structure 130 embedded in the casting. The first concrete-integrating-structure 130 can be welded or otherwise attached to the first chassis 126 prior to casting the concrete ballistic liner 128. The concrete-integrating-structure 130 appears as "v-shaped" cross-sections which means that in the example shown herein they are a series of winged-shaped metal pieces attached at their apices to the chassis.

The first shield member can also include data sensors 132 embedded in the concrete ballistic liner 128. The sensors 132 can include the types of sensors 112 described above in connection with FIG. 1.

The shield 120 also includes a second shield member 134 containing a second metal chassis 136 and a second ballistic liner 138 of an ultra high strength concrete casting on the second chassis 136. The second shield member also includes a second concrete-integrating structure 140 embedded in the casting. Similar to the first shield member, the second concrete-integrating-structure 140 can also be attached, such as by welding, to the second chassis 136 prior to casting concrete ballistic liner 138.

The concrete-integrating-structure, shown as "v-shaped" in cross-sections 130 and 140, can have other configurations such as a grid composed of bars criss-crossed and secured to each other and to the chassis such as by welding.

The first and second shield members 124 and 134 can be slidably interlocked via chassis 126 and 136 around the tension cable 122 to form shield 120 which surrounds the cable 122. The respective surfaces of each chassis (126 and 136) facing the tension cable 122 can also have a fire resistant coating 125 which provides thermal protection to the tension cable 122 against elevated temperatures generated by blast and fire.

The shield of the present invention can also include a blast defeating layer, preferably made of metal, disposed on the outside of the assembled shield. Thus, in FIG. 1 a blast defeating layer 210 is shown in phantom on the outside of shield 102. Similarly, in FIG. 2 and FIG. 3 a blast defeating layer 212 is depicted in phantom. Blast defeating layers are preferably made from metal selected from the group consisting of steel, aluminum, stainless steel, titanium, and mixtures and/or alloys thereof.

Figure 3:
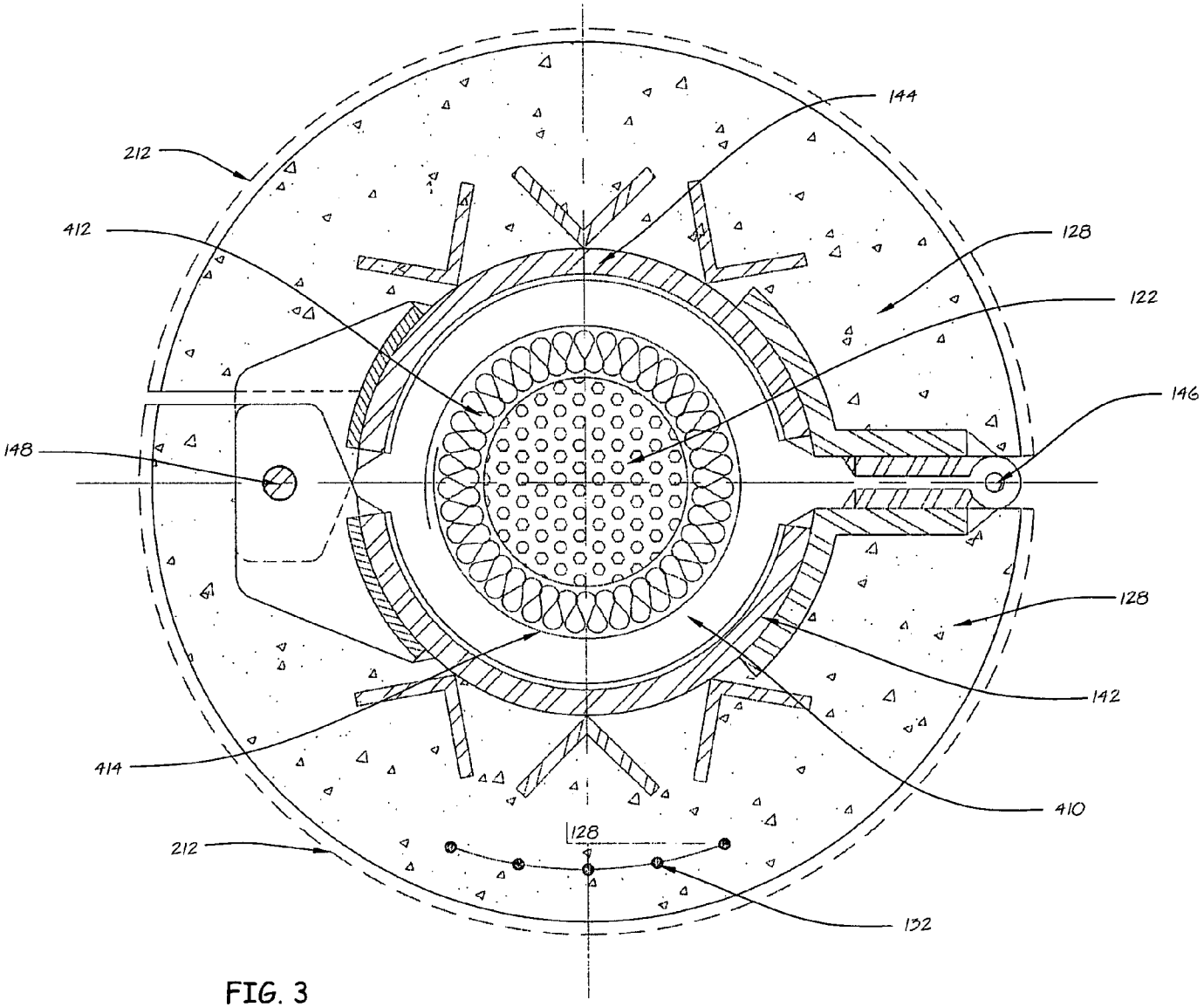
FIG. 3 is a cross-sectional view of a shield according to yet another preferred embodiment of the invention that includes a metal chassis that is in the form of a hinged assembly that has been interlocked around a tension cable to be protected.

FIG. 3 is a cross-sectional view of a shield similar to the shield shown in FIG. 2, but which includes a hinged metal chassis instead of a slidably interlocked metal chassis. The hinged assembly consists of a first metal chassis 142 and a second metal chassis 144 connected by a hinge 146 and interlocked around a tension cable by a pin 148 opposite the hinge 146. (The pin connection does not have to be located precisely opposite hinge 146).

Figure 4:
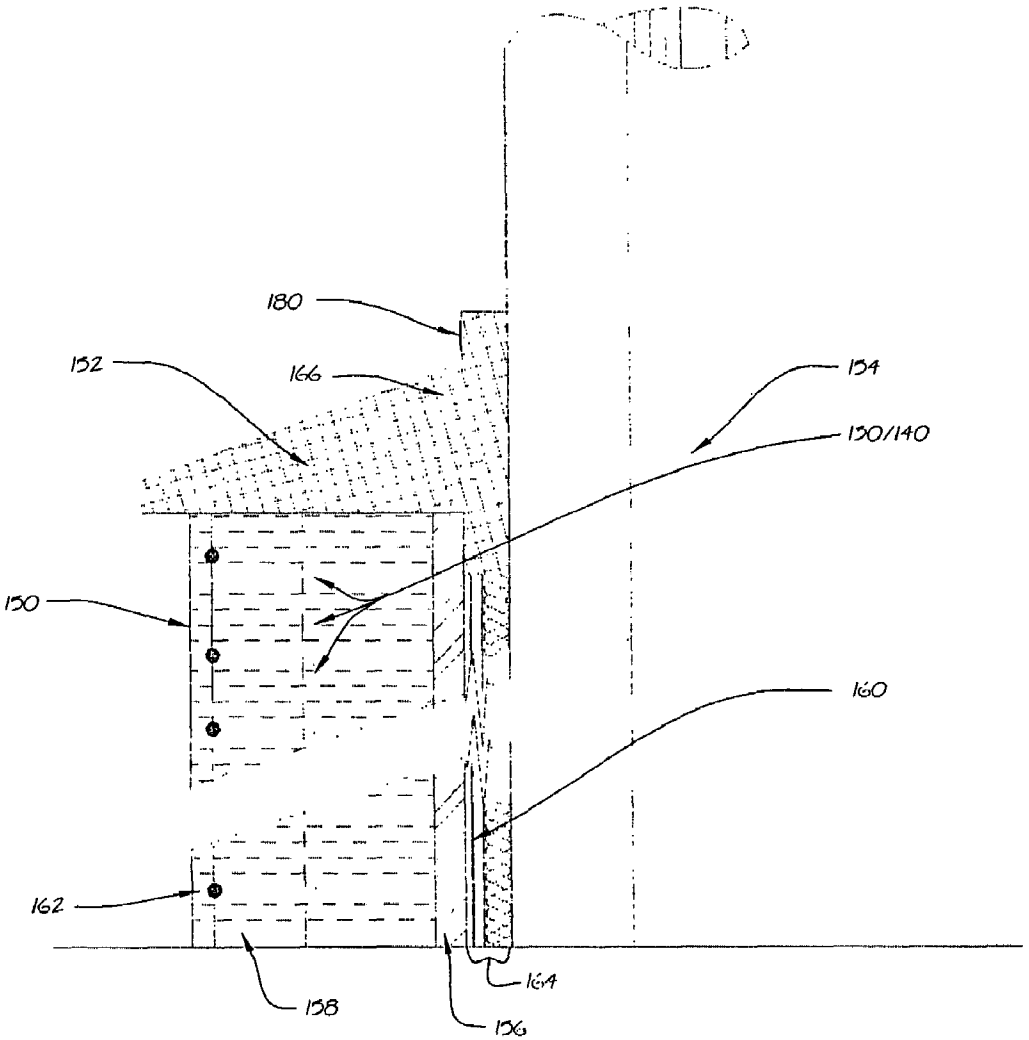
FIG. 4 is partial side elevation view, partly in cross-section, showing a shield that includes an end cap according to a preferred embodiment of the invention assembled around a tension cable.

FIG. 4 is, a partial side elevation view, partly in cross-section, of a shield 150 having an end cap 152 according to a preferred embodiment of the invention and assembled around a tension cable 154. The shield 150 includes a chassis 156, a ballistic liner 158 disposed on chassis 156, a heat resistant coating 160 disposed on chassis 156 (opposite the ballistic liner 158) and data sensors 162 embedded in the ballistic liner 158. The end cap 152 is positioned on the end of the shield 150 to prevent weather and debris from infiltrating annular space 164, the space between the shield 150 and the cable 154. The end cap 152 fits into the space 164 and is secured to the cable 154 by a clamp 166. The concrete-integrating-structure(s) 130/140 are seen in this view by the ends of the upper edges of the "v-shaped" metal pieces.

Figure 5:
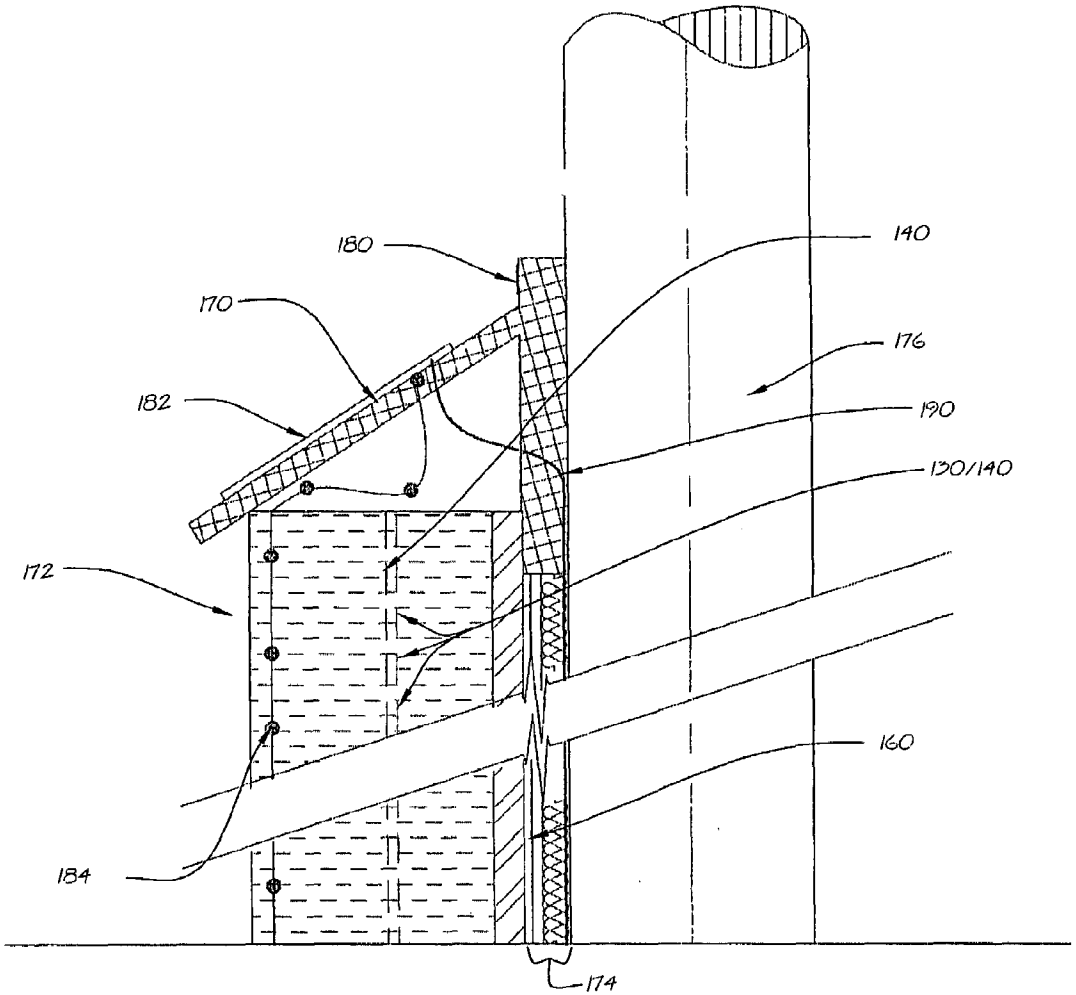
FIG. 5 is partial side elevation view, partly in cross-section, showing a shield that includes an end cap according to another preferred embodiment of the invention assembled around a tension cable.

FIG. 5 shows a shield similar to that of FIG. 4, but having a different style of end cap 170. The end cap 170 is positioned on the end of the shield 172, fits into the space 174 between the shield 172 and the tension cable 176, and is secured to the cable 176 by a clamp 180. The cap 170 also includes a solar powered transmitter 182 connected to data sensors 184. The transmitter 182 is powered by solar energy and transmits data to a remote receiver by wireless communication.

Shield System

The present invention also includes a shield system. The system has a thermally-insulative/ballistic liner 410 disposed on the protected structural element, especially a tension cable, between the protected element and the shield.

The thermally-insulative/ballistic liner is on the non-threat side of the shield, e.g., between the inner surface of the shield and the outer surface of the tension cable, to provide additional protection to the tension cable. The thermally-insulative/ballistic liner can be a single material in a single layer or more than one layer, e.g., multiple layers of a single material or multiple materials.

In the drawings, the thermally-insulative/ballistic liner is shown with two layers, a jacket 414, and a blanket layer 412. The blanket layer 412 is preferably made of a refractory material such as ceramic fibers. For example, the blanket layer 412 can be Kaowool™ refractory blanket or Inswool™ refractory blanket.

The jacket 414 can be those materials known for their protective ballistic properties. Numerous materials which can be used for the jacket layer include materials that are known for use in other application such as ballistic covers for military vehicles, personal armor, etc. Typically, the ballistic cover is a woven or non-woven textile fabric, or textile fabric of both woven and non-woven material. Suitable materials include glass fibers of all types, polyaramide fibers such as Kevlar® polyaramide fiber; high modulus polyolefin fiber such as SPECTRA® polyethylene fiber; aliphatic polymide fibers; steel fibers, including those of stainless steel; titanium fibers; carbon fibers; ceramic fibers; and the like. The fibers may be present as individual fibers, tows or strands of fibers, yarn woven from fibers or from strands, or in any suitable combination. Yarn, strands, tow, etc., may consist of a single type of fiber or a plurality of different types of fibers. The fibers are preferably continuous fibers, however, chopped fibers such as staple fibers are lengths of about 1 cm to about 7 cm, or longer discontinuous fibers, e.g., having length in excess of 7 cm, are also useful, particularly when used in conjunction with continuous fibers. In use the material is set up using an epoxy or the like to form a jacket 414.

The fibers, strands, tow, yarn, etc. may be present in the form of a woven or non-woven sheet material, e.g., a textile material, preferably a woven textile material. These woven or non-woven sheet materials may be used as a single layered composite sheet material or may be composed of multiple layers. By way of example, two woven polyaramide fabrics may sandwich a further woven or non-woven layer of steel mesh; conventional natural or synthetic fiber fabric, woven or non-woven; a layer of flexible foam, i.e., a polyolefin or polyurethane foam; or a layer of unconsolidated or fully or partially consolidated chopped fibers. These examples are not limiting. A preferred example of a liner material is SPECTRA® manufactured by Honeywell.

Preferably, the jacket secures the blanket layer to the protected structural element so that the blanket material does not migrate away from the protected structure. In the case of a tension cable, the jacket can be cylindrically shaped member (e.g., tube) having an opening running linearly along the tube. The tube can simply be opened linearly and placed over a cable on which a material such as a Kaowool™ refractory blanket has already been wrapped. The tube is a rigidfied ballistic material as described above which will snap back around the Kaowool™-wrapped cable. Preferably, the jacket will have either (or both), heat resistance and ballistic properties which further enhance protection of the structural member, e.g., cable.

In another aspect, the invention is directed to a method for mitigating damage to a structural element, e.g., a tension cable, from an explosive blast. The method includes assembling a shield as discussed above around the structural member. When the energy absorbing shield is pre-manufactured rather than prepared in situ, the shield is wrapped or otherwise placed around the tension cable. Optionally the cable is first coated with an anticorrosive composition such as a filled oil or grease, and subsequently the shield (with or without a thermally-insulative/ballistic liner) is applied and secured.

As shown in FIG. 6, the shield 100 may be applied along the entire length of the cable 502 or only on portions thereof, preferably lower portions which would be more likely to be exposed to a blast or to projectiles which result from the blast. For long cables for radio towers or the cables 502 of suspension bridges 500 remote from the lower portion of the parabolic supporting cables, for example, coverage of one third to one half the length may be appropriate. In such cases, provision may be made for lifting the shield so that the cable may be inspected. Such provision may be, for example, a hook, grommet, or loop of material which is then used to lift the shield.

The energy absorbing shield of the invention preferably includes a concrete casting and metal chassis with a metal concrete-integrating-structure welded to the metal chassis. However, additional layers or components may be added as well, or the structure may be limited to the two necessary components, i.e., the concrete casting and metal chassis. This positioning may also be reversed where the metal chassis faces the threat and the ultra high strength reactive powder concrete is the metal chassis. In another embodiment, the metal chassis may be sandwiched between two concrete castings.

Yet another feature of the present invention is the use of a tracing wire 190 (in FIG. 5) which can be used to heat the area 164 between the interior of the shield and the cable 154. The tracing wire can be powered by a solar collector 182 also see in FIG. 5.

Thus, while there has been described what is presently believed to be preferred embodiments of the invention, those skilled in the art will appreciate that other and further changes and modifications can be made without departing from the scope or spirit of the invention.

What is claimed is:

1. A shield for shielding an exposed structural member of a pre-existing structure from an explosive blast, said shield comprising:

at least two shield members which are pre-formed and not initially assembled to a structural member of a pre-existing structure, said shield members being pivotably connected to each other via a hinge assembly to enclose at least a length of said structural member upon being retrofitted to said structural member, said shield members defining an annular space between said structural member and said shield members to provide protection to said enclosed portion from an explosive blast, each of said shield members comprising;

(a) a metal plate having an interior surface and an outer surface, (b) at least one ultra high strength concrete ballistic liner cast on said outer surface of said metal plate such that said metal plate is more proximal to said structural member than said ballistic liner, and (c) a concrete-integrating-structure attached to said outer surface of said metal plate and embedded in said concrete ballistic liner, said concrete-integrating-structure and said outer surface of said metal plate forming a plurality of concrete retaining pockets, said interior surface of said metal plate being spaced from and facing said structural member and said concrete ballistic liner having an exterior surface facing the exterior environment where a blast can occur, and wherein said shield comprises at least two discrete concrete ballistic liners, at least one concrete ballistic liner being provided for each metal plate.

2. A shield according to claim 1, wherein said metal plate comprises a metal selected from the group consisting of aluminum, steel, stainless steel, titanium, and alloys or mixtures thereof.

3. A shield according to claim 1, wherein said concrete comprises metallic fibers.

4. A shield according to claim 3, wherein said metallic fibers are present in an amount of up to about 120 kg/m$^3$ per volume of concrete.

5. A shield according to claim 4, wherein said metallic fibers are present in an amount of about 20 to about 120 kg/m$^3$ per volume of concrete.

6. A shield according to claim 5, wherein said metallic fibers are present in an amount of about 40 to about 100 kg/m$^3$ per volume of concrete.

7. A shield according to claim 3, wherein said metallic fibers comprise steel fibers.

8. A shield according to claim 1, wherein said concrete comprises:

(a) a flexure strength Rfl measured on prismatic samples, higher than or equal to 15 MPa; and (b) a compression strength Rc measured on cylindrical samples, higher than of equal to 120 MPa, said flexural strength and compression strength being evaluated at the end of a 28 day time period.

9. A shield according to claim 1, wherein said concrete-integrating-structure comprises a plurality of metal v-shaped members having apices attached to said plate, said v-shaped members and said plate forming said plurality of concrete retaining pockets.

10. A shield according to claim 1, wherein said shield members are capable of being interlocked around said enclosed portion.

11. A shield according to claim 1, wherein said hinged assembly comprises a hinge pivotably connecting one edge of each metal plate together and a pin interlocking an opposite edge of each metal plate together.

12. A shield according to claim 1, wherein at least one shield member comprises at least one data sensor embedded in said concrete for detecting a threat to said shield and/or the protected structural member.

13. A shield according to claim 12, wherein said sensor detects a threat selected from the group consisting of an elevated temperature, excessive vibrations, an explosive blast and others events affecting the integrity of said shield assembly.

14. A shield according to claim 13, further comprising a system for transmitting threat data to a remote receiver.

15. A shield according to claim 12 further comprising a source of electrical energy which is solar powered for operating said as least one sensor.

16. A shield according to claim 1, wherein said structural member is a tension cable and said shield has a substantially annular shape with an inner surface adjacent to said cable and an outer surface facing outward towards a potential explosive blast.

17. A shield according to claim 16, further comprising at least one end cap which fits around said tension cable sufficiently snugly to substantially prevent weather or debris from entering annular space within said inner surface.

18. A shield according to claim 1 further comprising a heat resistant coating disposed on at least one of said interior surface and said exterior surface of said shield.

19. A shield according to claim 1 said shield further comprising a blast defeating layer disposed on the surface exposed to said blast.

20. A shield according to claim 19 wherein said blast defeating layer is a metal layer.

21. A shield according to claim 20 wherein said metal layer comprises a metal selected from the group consisting of aluminum, steel, stainless steel, titanium, and mixtures or alloys thereof.

22. A shield according to claim 1 which further comprises at least one solar collector as a source of energy for use with and/or in said shield.

23. A shield according to claim 1 which further comprises a heat tracing wire.

24. A shield according to claim 1, wherein said cast ultra high strength concrete has a lower thickness limit of not less than about 0.5 inches.

25. A shield according to claim 24 wherein said lower thickness limit is not less than about 1.0 inches.

26. A shield according to claim 25 wherein said lower thickness limit is not less than about 1.5 inches.

27. A shield according to claim 1, wherein said ultra high strength concrete has an upper thickness limit of not greater than about 4.0 inches.

28. A shield according to claim 27 wherein said ultra high strength concrete has an upper thickness limit of not greater than about 3.0 inches.

29. A shield according to claim 28 wherein said ultra high strength concrete has an upper thickness limit of not greater than about 2.5 inches.

30. A shield as defined in claim 1, wherein said metal plate and said ballistic liner are substantially longitudinally and laterally coextensive along the enclosed length of the structural member.

31. A tubular shield for protecting an exposed structural member of a pre-existing structure from an external explosive blast, the shield including two shield members pivotably connected to each other via a hinge assembly for substantially enclosing at least a length of the structural member, each of said shield members comprising:

(a) a metal chassis including a plate having an inner surface for facing the structural member and a plurality of v-shaped members having apices attached to an outer surface of said chassis plate, said v-shaped members and said outer surface of said chassis plate forming a plurality of concrete retaining pockets; and (b) an ultra high strength concrete ballistic liner cast on said outer surface of said chassis plate and retained on said chassis by said concrete retaining pockets of said chassis, and wherein said hinged assembly includes a hinge pivotably connecting one edge of each chassis together and a pin interlocking an opposite edge of each chassis together, and wherein said shield members are pre-formed and not initially assembled to the structural member of a pre-existing structure, said shield members defining an annular space between said structural member and said shield members upon being retrofitted to said structural member to provide protection to said enclosed portion from an explosive blast, and wherein said shield comprises at least two discrete concrete ballistic liners, at least one concrete ballistic liner being provided for each metal chassis plate.

32. A shield as defined in claim 31, wherein the exposed structural member is a tension cable of a suspension bridge.

33. A shield as defined in claim 31, wherein said metal plate and said ballistic liner are substantially longitudinally and laterally coextensive along the enclosed length of the structural member.

34. In combination:

an exposed structural member of a pre-existing structure; and a shield for protecting the structural member from an explosive blast, said shield including at least two shield members which are pre-formed and not initially assembled to said structural member of said pre-existing structure, said shield members being pivotably connected to each other via a hinge assembly to enclose at least a length of said structural member upon being retrofitted to said structural member, said shield members defining an annular space between said structural member and said shield members to provide protection to said enclosed portion from an explosive blast, each of said shield members comprising;

(a) a metal plate having an interior surface and an outer surface, (b) at least one ultra high strength concrete ballistic liner cast on said outer surface of said metal plate such that said metal plate is more proximal to said structural member than said ballistic liner, and (c) a concrete-integrating-structure attached to said outer surface of said metal plate and embedded in said concrete ballistic liner, said concrete-integrating-structure and said outer surface of said metal plate forming a plurality of concrete retaining pockets, said interior surface of said metal plate being spaced from and facing said structural member and said concrete ballistic liner having an exterior surface facing the exterior environment where a blast can occur, and wherein said shield comprises at least two discrete concrete ballistic liners, at least one concrete ballistic liner being provided for each metal plate.

35. A shield as defined in claim 34, wherein said metal plate and said ballistic liner are substantially longitudinally and laterally coextensive along the enclosed length of the structural member.

36. A shield as defined in claim 34, wherein said exposed structural member is a tension cable of a suspension bridge.

* * * * *